United States Patent [19]

Schmidt

[11] Patent Number: 4,498,253

[45] Date of Patent: Feb. 12, 1985

[54] SNOW REMOVAL

[76] Inventor: Alfred Schmidt, Friedrich Strasse 17, D-7822 St. Blasien, Fed. Rep. of Germany

[21] Appl. No.: 511,959

[22] Filed: Jul. 8, 1983

[30] Foreign Application Priority Data

Jul. 14, 1982 [DE] Fed. Rep. of Germany ..... 3226273

[51] Int. Cl.[3] ..... E01H 5/09

[52] U.S. Cl. ..... 37/249; 37/197; 37/254; 37/117.5; 37/DIG. 3

[58] Field of Search ..... 37/241, 242, 244, 248, 37/249, 253, 254, 117.5, 197, DIG. 3, DIG. 12

[56] References Cited

U.S. PATENT DOCUMENTS

| | | | |
|---|---|---|---|
| 1,594,234 | 7/1926 | Aikin | 37/242 X |
| 1,870,591 | 8/1932 | Saxon | 37/254 |
| 2,109,393 | 2/1938 | Le Bleu | 37/254 X |
| 2,241,252 | 5/1941 | Garland et al. | 37/254 X |
| 2,632,263 | 3/1953 | Cooper | 37/242 X |
| 2,863,233 | 12/1958 | Johnson | 37/117.5 X |
| 3,074,188 | 1/1963 | Ethyre | 37/254 |

FOREIGN PATENT DOCUMENTS

| | | | |
|---|---|---|---|
| 729860 | 3/1966 | Canada | 37/249 |
| 739159 | 7/1966 | Canada | 37/249 |
| 821411 | 8/1969 | Canada | 37/249 |
| 2147001 | 4/1973 | Fed. Rep. of Germany . | |
| 2455300 | 5/1976 | Fed. Rep. of Germany | 37/249 |
| 113320 | 2/1945 | Sweden | 37/DIG. 3 |

*Primary Examiner*—Edgar S. Burr
*Assistant Examiner*—Moshe I. Cohen
*Attorney, Agent, or Firm*—George E. Kersey

[57] ABSTRACT

A snowblower with a propeller drum seated on a free support axle that is disposed horizontally and perpendicular to the driving direction. The support axle is operated by a drive which is situated centrally within the drum. The snowblower also serves a lateral snowblowing function by the connection of a snowplow in place of the usual second drum. The side of the snowplow adjacent to the propeller drum is fixed rigidly to the housing. The back side of the snowplow is connected to a bushing which can be placed on the support axle normally provided for the removed propeller drum.

11 Claims, 5 Drawing Figures

SNOW REMOVAL

BACKGROUND OF THE INVENTION

This invention relates to snow removal, particularly by snowblowers in which propeller drums are mounted on centrally driven support axles.

Such a "drum" snowblower, which typically is provided with two drums, is illustratively described in German Pat. No. 2,147,001. The clearing width of a drum snowblower is typically in the range from two to three meters when two drums are used. Generally a separate ejection chimney is associated with each drum. Snow taken up by a drum is then freely ejected through a corresponding ejection chimney, or is conveyed to a loading surface, such as that of a truck.

When snow accumulates in banks, such as in city areas, another type of snowblower has been found to be advantageous. This is the "lateral" blower which has a clearing width formed in part by a propeller drum and in part by a feed-in plow. The plow is disposed at a slant, with an outer edge in the clearing direction before an inner edge adjacent to the drum. The feed-in plow conveys snow from the side to the front of the drum which disposes of both the conveyed and the frontal snow.

In many cases it is desirable to use a snowblower for both the removal of snowbanks and surface clearing of roads and parking lots. The lateral snowblower has limited suitability for surface cleaning. Because of its feed-in plow, the lateral blower tends to stick in snow which is heavy or has substantial accumulation.

The double drum snowblower, on the other hand, is inefficient for the removal of snowbanks. This is because the propeller drum next to a snowbank rotates without being in contact with the snow. Not only is there a resultant waste of energy, there also is an appreciable risk that the ejection chimney of the unloaded drum will become clogged. This is because there is little or no conveyance of snow so that the ejection rate of the snow is correspondingly low. When an ejection chimney becomes clogged, which can occur frequently in the presence of snowbanks, the clearing operation must be interrupted to permit unclogging. In addition, the unloaded drum which is in continuous rotation presents a hazard to passersby.

Accordingly, it is an object of the invention to facilitate the removal of snow. A related object is to achieve efficient snow removal for both the clearing of snowbanks and surface areas.

Another object of the invention is to overcome the disadvantages and inefficiencies associated with lateral snowblowers in the clearing of surface areas. A related object is to achieve the efficient clearing of snow which has been deposited on surfaces in appreciable levels, or which has become compacted and is difficult to move.

Still another object of the invention is to overcome the disadvantages associated with drum snowblowers. A related object is to avoid the chimney clogging that often occurs when such a snowblower is used to clear snowbanks. Another related object is to avoid hazards to passersby from rotating propeller drums.

SUMMARY OF THE INVENTION

In accomplishing the foregoing and related objects, the invention provides for a universally useable snowblower, i.e., one that is suitable both for clearing snowbanks and for clearing surface areas.

According to the invention, this is achieved by connecting a snowplow in place of one of two propeller drums, so that the side adjacent to the remaining drum is fastened to the housing and its backside is connected through a support to a bushing which can be placed on the free support axle of the drive.

Such a snowblower offers the possibility of simple conversion from a snowblower with two propeller drums into a lateral snowblower with a single propeller drum and a snowplow. When used for right-hand traffic, as viewed in the clearing direction, the propeller drum that would otherwise appear on the inside of the path being cleared is replaced by the snowplow. Within the framework of the invention, this is done simply by removing a propeller drum from its support axle and placing a snowplow bushing over the axle. The plowing angle can be varied by varying the length of the support. This can be done stepwise or continuously, manually or automatically, mechanically with a motor drive or hydraulically.

By shaping the blade of the snowplow symmetrically with respect to its horizontal axis, it is possible to affix the snowplow optionally in place of either propeller drum. The only precondition is that fastening elements for loosenably fastening the clearing rail be provided both at the upper and lower edges of the plow blade.

The height and length of the snowplow can be matched to the diameter and length of one half of the propeller drum. With such a design, there is no gap in the blower housing where the drum has been removed.

DESCRIPTION OF THE DRAWINGS

Other aspects of the invention will become apparent after considering several illustrative embodiments taken in conjunction with the drawings, in which.

DETAILED DESCRIPTION

Figure 1:
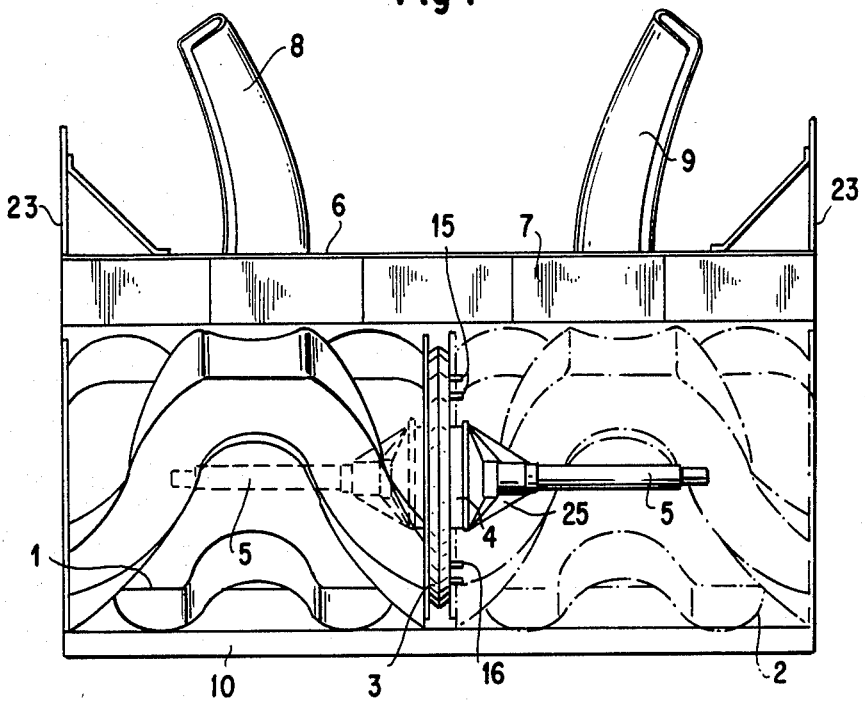
FIG. 1 is a frontal view of a drum snowblower with one propeller drum removed.

With reference to the drawings, FIG. 1 shows a drum snowblower with a single propeller drum 1. A second drum 2 that normally is provided has been removed and its usual position is shown in phantom with dots and dashes. The drums 1 and 2 normally adjoin an annular ridge 3. The latter is securely attached to a housing and supports as a drive 4 at the position of the propeller drums, together with oppositely projecting support axles 5.

Figure 3:
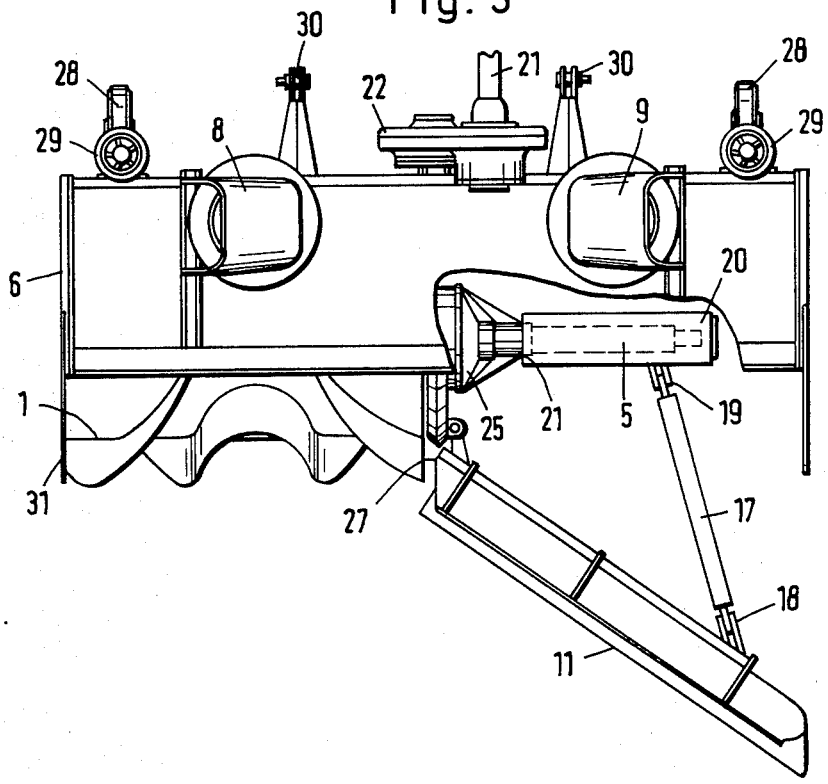
FIG. 3 is a top view of the snowblower of FIG. 1 with the snowplow of FIG. 2 connected.

As shown in FIG. 3, the drive operates through a driven shaft 21. Acting through a chain-wheel drive 22, the drive shaft 21 propels the drive 4 of the axles 5. The drive 4, e.g., an angular gear, is situated centrically between the positions of the two hollow propeller drums.

Returning to FIG. 1, the housing 6 of the blower has movable flaps 7 at its upper front edge to prevent the ejection of snow in the forward direction. Two ejection chimneys 8 and 9 are seated on the housing 6. The drum 1 is associated with the chimney 8; the second chimney 9 is normally associated with the removed drum 2. Along the lower edge of the housing 6 of the blower, there is a replaceable wear rail 10. Removable snow blades 23 at the upper lateral edges of the housing 6 of the blower are used to cut overhanging snow banks.

FIG. 2 shows a snowplow 11 with a clearing rail 12. At its left vertical edge, it has lugs 13 and 14 which are used for a hinged connection to the corresponding double lugs 15 and 16 of the annular ridge 3 in FIGS. 1 and 4. The bolts for securing these hinge connections are not shown. On the back side of the snowplow 11, as can be seen in FIG. 3, an adjustable support 17 makes a hinge connection at pivot 18. The opposite end of the support 17 is likewise hinged with a bushing 20 at pivot 19. The bushing 20 has a central opening for the support axle 5. The bushing 20 is placed over the support axle 5 until it encounters a stop 21, located on the drive side of the housing 25. Thus, the support axle 5 completely fills the central opening of the bushing 20.

Figure 2A:
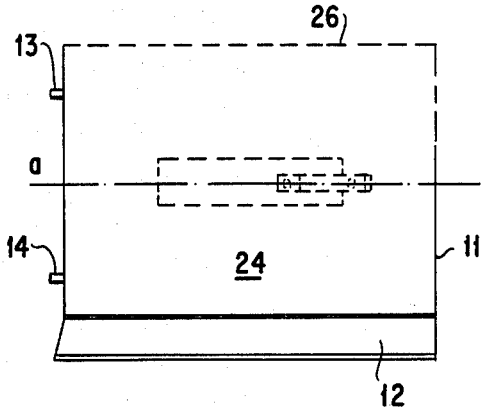
FIGS. 2A and 2B are frontal views of a snowplow for use with the blower of FIG. 1 in accordance with the invention.
Figure 2B:
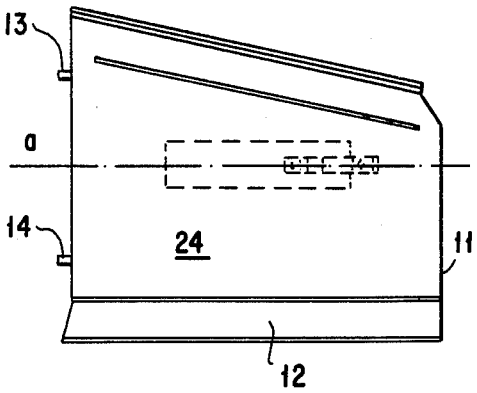

The snowplow 11, as shown in dashed line edge 26 in FIG. 2A can be shaped symmetrically with respect to a horizontal axis a, or unsymmetrically as shown in FIG. 2B. As a result of symmetrical shaping of the plow blade 24, it is possible to affix the snowplow 11 optionally in place of either the left-hand propeller drum 1 or the right-hand propeller drum 2. In that case, only the clearing rail 12 would have to be fastened at the opposite edge 26. With a symmetric design of the plow blade 24, corresponding to the dashed part of the drawings, there is no difficulty in affixing corresponding fastening elements along both horizontal edges of the snowplow.

From FIG. 3 it can be seen that the back side of the blower housing 6 has blower wheels 28 on both sides, with their hand wheels 29 that are used for height adjustments. Furthermore, two coupling supports 30 are provided to fasten the blower housing 6 to the front side of the carrier vehicle (not shown) Bumper rings 31 at the outer sides of the blower housing 6 protect the propeller drum 1 against damage.

Figure 4:
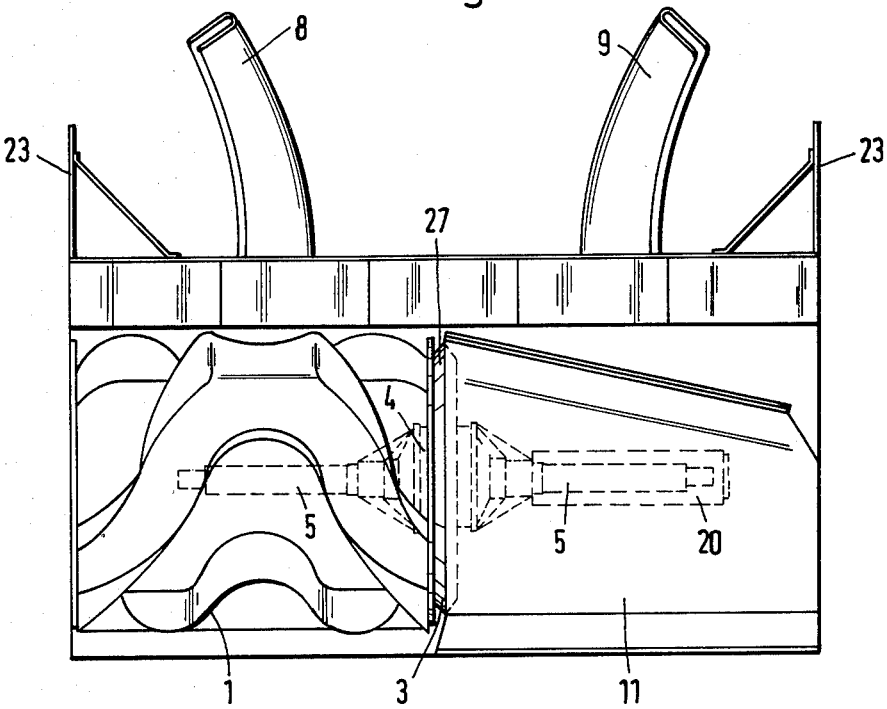
FIG. 4 is a front view of a combination snowblower and snowplow of FIG. 3.

In FIG. 4, the snowplow 11 is shown in its attached state from the front of the blower unit. The left vertical edge 27 covers the annual ridge 3 to about its middle. The drive 4 is shown in dashes and operates two support axles 5, which extend freely to the right and left, respectively. In the particular embodiment of FIG. 4, only the support axle 5 on the left has an associated propeller drum 1. The support axle 5 on the right is used with the bushing 20 for the support 17. The ejection chimney 9 on the right is not operational when the feed-in snowplow is attached according to FIG. 4.

While various aspect of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A snowblower with free support axles for a plurality of removable propeller drums mounted within a housing, said axles being situated horizontally and perpendicular to the driving direction of said drums and including a drive for the propeller drums, means for replacing one of said propeller drums with a snowplow blade including a bushing means mountable on one of said free support axles when said propeller drum has been removed, means mounting the end of said blade nearer to the remaining propeller drum rigidly to said housing, and adjustable means for mounting the end of said blade which is remote from said remaining propeller drum to said bushing means carried by said one of said free support axles from which the propeller drum has been removed, and for adjusting the angle of said blade relative to its support axle by said adjustable means.

2. A snowblower, according to claim 1, wherein said adjustable means comprises a support designed so that its length is adjustable.

3. A snowblower, according to claim 1, with a narrow annular ridge affixed to the housing, between the support axles, characterized in that a vertical edge of said snowplow is hinged to said annular ridge.

4. A snowblower, according to claim 1, characterized in that the blade of the snowplow is shaped symmetrically with respect to a horizontal axis, and fastening elements to connect a clearing rail are disposed at the two horizontal edges of the plow blade.

5. A snowblower, according to claim 2, with a narrow annular ridge affixed to the housing, between the support axles, characterized in that a vertical edge of said snowplow is hinged to said annular ridge.

6. A snowblower, according to claim 2, characterized in that the blade of the snowplow is shaped symmetrically with respect to a horizontal axis, and fastening elements to connect a clearing rail are disposed at the two horizontal edges of the plow blade.

7. A snowblower, according to claim 3, characterized in that the blade of the snowplow is shaped symmetrically with respect to a horizontal axis, and fastening elements to connect a clearing rail are disposed at the two horizontal edges of the plow blade.

8. The method of adapting a drum snowblower for use in the removal of snowbanks as well as the clearing of surfaces, which comprises the steps of (a) removing a propeller drum from its support axle;
(b) mounting a bushing means on said support axle; and
(c) replacing the removed drum by a snowplow blade adjustably supported at one end by said bushing means and at the other end by a housing member.

9. The method of claim 8 in which the step of replacing the removed drum by a snowplow blade includes rigidly fixing said snowplow to the housing of said snowblower adjacent a remaining propeller drum.

10. The method of claim 8 further including the step of connecting a vertical edge of said snowplow to an annular ridge that supports the drive of a propeller drum.

11. The method of claim 10 wherein said vertical edge is hinged to said annular rib.

* * * * *